United States Patent [19]

Garschke et al.

[11] Patent Number: 4,620,988

[45] Date of Patent: Nov. 4, 1986

[54] FLAME HYDROLYSIS COATING APPARATUS PARTICULARLY FOR DENTAL PROSTHESES

[75] Inventors: Adelheid Garschke, Saalfeld; Hans-Jürgen Tiller, Jena; Roland Göbel, Jena; Brigitte Magnüs, Jena, all of German Democratic Rep.; Steffen Oppawsky, Bad Homburg, Fed. Rep. of Germany

[73] Assignee: Kulzer & Co. GmbH, Wehrheim, Fed. Rep. of Germany

[21] Appl. No.: 728,771

[22] Filed: Apr. 30, 1985

[30] Foreign Application Priority Data

Jun. 27, 1984 [DE] Fed. Rep. of Germany ..... 3423637

[51] Int. Cl.[4] ..... B05D 3/08

[52] U.S. Cl. ..... 427/223; 118/47; 118/500; 433/218; 427/224; 427/226; 427/399

[58] Field of Search ..... 118/47, 500; 427/223, 427/224, 226, 399; 433/218

[56] References Cited

U.S. PATENT DOCUMENTS 2,431,781 12/1947 Wagner ..... 118/47

*Primary Examiner*—Norman Morgenstern
*Assistant Examiner*—Janyce A. Bell
*Attorney, Agent, or Firm*—Frishauf, Holtz, Goodman & Woodward

[57] ABSTRACT

To improve coating of articles such as dental prostheses by flame hydrolysis, a zone of turbulence is generated at the tip portion of an elongated flame cone by a deflection surface (5, 5') located—with respect to flame projection—beyond holders for the articles and positioned to be impinged by the tip of the flame to be deflected and reflected thereby from the conical form, to cause the flame to swirl about the articles.

31 Claims, 14 Drawing Figures

FLAME HYDROLYSIS COATING APPARATUS PARTICULARLY FOR DENTAL PROSTHESES

Reference to related application, assigned to the assignee of the present invention, the disclosure of which is hereby incorporated by reference; patent application U.S. Ser. No. 06/686,211, filed Dec. 26, 1984, GOBEL et al (corresponding to German No. P 34 03 894).

The present invention relates to a flame hydrolysis coating apparatus to coat articles with a silicon oxide layer which promotes adhesion of the articles, typically dental prostheses, and is an improvement over the application U.S. patent application Ser. No. 06/686,211, filed Dec. 26, 1984, assigned to the assignee of the present application, the disclosure of which is hereby incorporated by reference.

BACKGROUND

The referenced U.S. patent application Ser. No. 6/686,211 describes an arrangement which is particularly suitable to coat metallic dental prosthesis components by flame hydrolysis. The arrangement includes holders to hold the metallic dental prosthesis parts, located at some distance from a source of silicon oxide. By flame hydrolysis, the dental prosthesis parts are coated with a silicon oxide layer which promotes adhesion of the metallic parts with plastics and the like injected, later, about the metallic parts. The referenced application describes placing the metallic parts within the flame cone of a flame hydrolysis burner, directed towards the dental prosthesis parts or elements. The length of the flame cone is at the most 25% longer than the distance between the flame hydrolysis burner and the dental prosthesis element. This insures the element to be coated is located outside of the region of the flame cone which might cause carbonization or deposit of carbon and soot. The part, also, is outside of the tip of the flame. During coating, the holder, which is located on a turret, is rotated with respect to the flame hydrolysis burner. Adjustment in various directions is possible; the turret insures that sequentially, different surface regions of the prosthesis elements, as well as single, different elements of the prosthesis are exposed to the flame cone. To insure that the prosthesis parts are coated at all sides, it is necessary to move the holder and/or the prosthesis element, from time to time, in its position relative to the flame cone. The arrangement has been found entirely suitable in actual use.

THE INVENTION

It is an object to improve a flame hydrolysis apparatus as described in the referenced application by improving the utilization of the region of the flame of the flame hydrolysis burner, and which further improves uniform coating of the articles or elements over their entire surfaces without having to shift the articles or elements with respect to the flame cone, or to shift the holders thereof, and which is simple and easily. adjusted for various articles to be coated.

Briefly, means are provided to generate turbulence at the tip of an elongated flame cone, formed, for example, by deflection surfaces located—with respect to flame projection or the length of the flame cone—beyond the holders for the articles. The deflection surfaces are positioned to be impinged by the tip of the flame, so that the tip is deflected thereby from the original cone form, to introduce turbulence at the end or tip portion of the flame and in the region of the articles held in the article holders, so that the articles, in the holders, are surrounded, essentially, from all sides by the projected flame and reflected, and deflected flame portions which have impinged on the deflection surface.

The deflection surface, located downstream—in the direction of the flame cone—from the articles to be coated prevents free flow or formation of the flame cone and turbulence at the tip of the flame cone is generated. The soot component which is present at the tip of the flame cone is thus heavily diluted, so that it no longer will interfere with coating of the articles. A higher, and highly desirable and advantageous, increased volume of the reaction zone is obtained, so that various articles, and typically dental prostheses, can be coated all around in one passage through the flame, as reflected and deflected by the deflection surface, by the swirl of the flame about the articles.

The composition of the flame and thus the characteristics of the coated zone are less dependent on the particular location of the respective coated zones on the articles, since the flame will, effectively, surround the articles at all sides. By generating tip turbulence upon impingement of the flame on the deflection surface, the back portions of the articles, typically dental prostheses, are also coated although they are remote from the sides or surfaces facing the burner generating and projecting the flame cone. Thus, the desired silicon coating layer can be applied to the prosthesis parts from all sides without having to turn the parts or their holders on the apparatus passing the parts through the flame, typically a turret.

A cylindrical or substantially cylindrical deflection surface has been found particularly suitable. The cylindrical deflection surface is so positioned that the cylinder axis forms an extension of the axis of rotation of a turret. A plurality of small dental prosthesis elements can be located around the cylindrical deflection surface element; it is also possible to locate one large dental prosthesis element in position in front of the cylindrical deflection surface. The articles to be coated are located on a turret and are passed in a repetitive cycle in front of the flame hydrolysis burner. The turret, together with the deflection surface, is rotated, for example and preferably, at a speed of about 30 to 60 rpm. This speed insures that excessive heating of the portion of the deflection surface which is behind the articles to be coated is avoided. The rotation of the elements additionally cools the elements between successive flame hydrolysis coating, that is, when they are again subjected to the flame as it impinges the cylindrical deflection surface. By using an essentially cylindrical deflection element, a plurality of articles located circumferentially outside of the deflection surfaces will, reliably, with uniform coating.

In accordance with a feature of the invention, the deflection surface can be formed as a dished deflection element having an axis of rotation extending parallel to the direction of the flame projected by a flame burner, the articles being located in front of the dished deflection surface. The offset between the axis of rotation of the turret which, in this arrangement, can be formed directly by the dished deflection surface, with respect to the axis of projection of the flame cone, preferably, is adjustable, the offset being so arranged that the articles will be subjected to the flame as it is being projected thereagainst. In this arrangement, the dished deflection surface directly forms the holder turret for the articles, which results in a particularly simple construction, and is suitable especially for small articles, such as small prosthesis components.

The deflection surface, preferably, is concave with respect to the flame; this increases the turbulence at the end or tip of the flame and, additionally, guides the flame in the region of the back portion of the articles. This effect is even enhanced by positioning the concave region above the flame—since hot air rises—so that, due to heat convection, the flame tip which tends to bend upwardly is deflected downwardly by the concave-shaped portion of the deflection surface. A radius of the profile of the concave surface of up to about 3 cm, and suitably less than that, has been found suitable when coating dental prosthesis elements.

DRAWINGS

The various Figures utilize identical reference numerals for similar components and, if the elements have similar function but are structurally different, they will be given prime, double prime, etc. notation.

DETAILED DESCRIPTION

Figure 1:
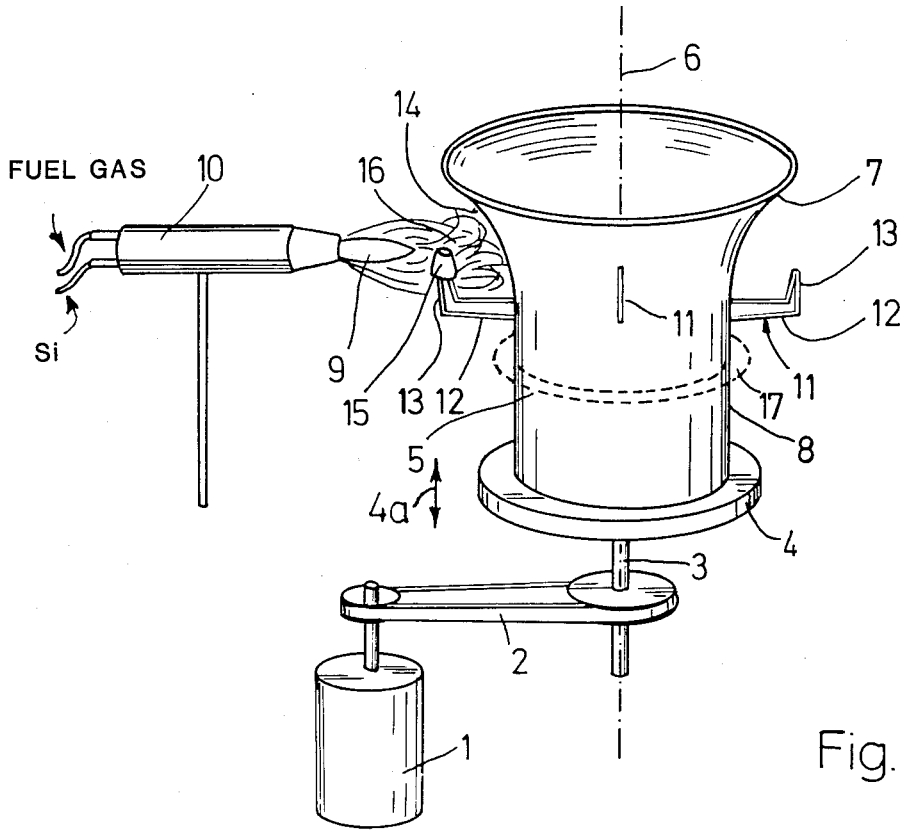
FIG. 1 is a schematic pictorial view of the flame hydrolysis apparatus using an upwardly expanding, essentially cylindrical deflection element.

Referring first to FIG. 1: A motor 1 is connected via a drive belt 2 to a shaft 3 of a turret 4. A cylindrical body 5, the surface of which forms a deflection surface for a flame—to be described below—is secured to the turret 4 such that the axis 6 of the body 5 is congruent with the axis of rotation 3.

The deflection body 5 is a thin-walled hollow cylinder made of special steel, which is expanded, in tulip form, at its free end 7, so that the outer contour or surface 8 of the body 5 has a concave profile with respect to the flame 9 projected from a burner, e.g. a gas burner, to which, additionally, a silicon containing substance can be added—as known, and as described in greater detail in the referenced application.

A plurality of holders 11 having support arms 12 are secured to the cylindrical body 5, projecting from the outer circumference of the surface 8 and being angled upwardly, as seen at 13, to retain samples, for example dental prosthesis element 15, thereon. The upward angling of the holders 12, as shown at 13, extends approximately at right angles to the surface 8, and upwardly towards the concave surface 14 of the body 5. The portion of the surface behind the articles 15—looked at in the direction of projection of the flame—causes extensive turbulence at the tip 16 of the flame projected from the burner 10—see FIG. 1—so that no disturbing soot deposition from the tip of the flame will occur. The tip portion of the flame is highly diluted, and thus provides a large effective reaction volume for the articles 15 to be coated. This arrangement insures coating of the articles from all sides and on all surfaces, that is, also on the surface which is opposite that of the flame 9 projected by the burner 10, without requiring repositioning of the articles 15 during coating.

Operation: For coating, the various articles 15 are carried, by rotation of the motor 1, past the flame 9 from the burner 10, and thus are cyclically coated. The turret 4 can be used to be flush with the outer circumference of the body 5, or—and as shown in FIG. 1, may form a projecting flange. This projecting flange additionally guides the shape and formation of the flame. An additional flame and air stream guide ring 17 may be placed about the body 5; since this is not a necessary feature, it is shown in broken lines in FIG. 1. Such a guide ring 17 is located, preferably, below the arms 12 and rotates with the body 5. It may be axially adjustable, and for different articles, a plurality of such rings 17, with different outer diameters, may be provided.

Figure 2:
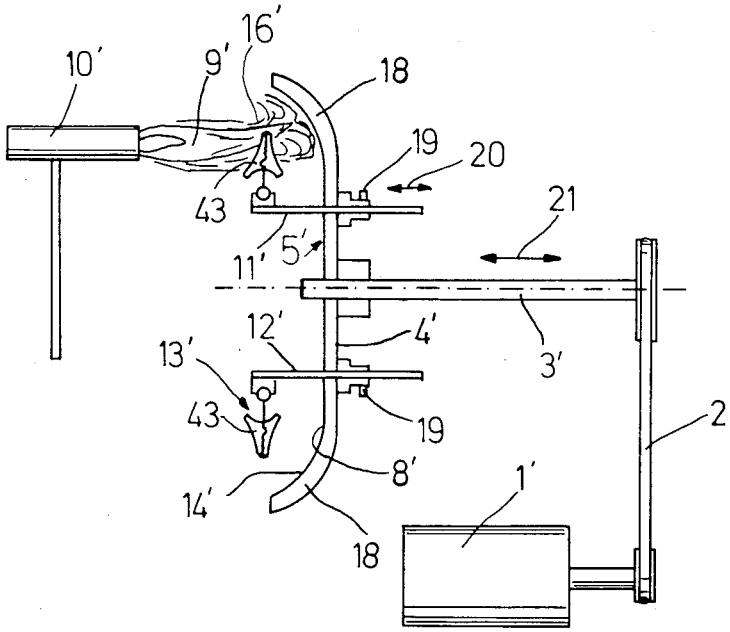
FIG. 2 is a side view, partly in section, of the apparatus using a dish-shaped deflection element.

In the embodiment of FIG. 1, the axis of rotation 3, and hence the axis 6 of the body 5 extends vertically. In the embodiment of FIG. 2, the axis of rotation 3' of the turret 4' is horizontal, being offset, however, vertically downwardly with respect to the flame 9'. The axis of rotation 3' and the direction of the flame 9 are parallel to each other. In this arrangement, the impingement surface 8' for the flame is formed directly by the turret 4' which is shaped to have a concave circumferential zone 18, in the region of the flame 9. The respective support arms 12' for the samples are carried through the dish-shaped turret, forming simultaneously the impingement body. The support arms 11', 12' are axially shiftable in the direction through the dish-shaped impingement body 5' forming, simultaneously, the turret 4', in the direction of the arrow 20, and can be held in position by set screws 19. This arrangement, in a very simple manner, insures that the spacing of the holders 13' and articles thereon can be readily changed with respect to their distance from the flame and/or the impingement surface 8' of the body 5'. Additionally, the entire turret 4', and hence the impingement body 5', is axially shiftable in the direction of the arrow 21, so that the entire impingement surface together with all the article holders and the articles thereon can be shifted relative to the flame 9', projected from the burner 10'. This dual adjustability of the turret 4' as well as of the support holders 11', 12' permits optimum adjustment of the reaction volume with respect to the articles held in the holders 12', 13'. The holders in FIG. 2 are shown as alligator clips, and will be described below in detail in connection with FIG. 13.

Figure 3:
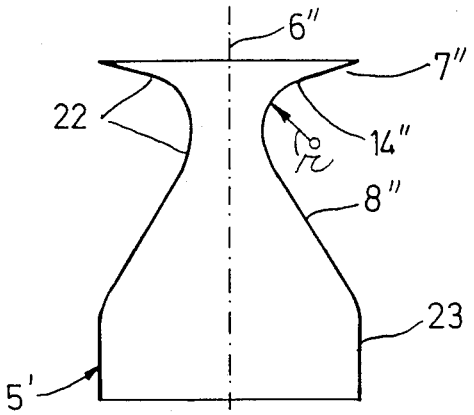
FIG. 3 is a schematic section of the shape of a deflection element.

The impingement body 5 of FIG. 1 is cylindrical—except for the flared expansion at the free end 17 thereof. Other shapes are possible. FIG. 3 illustrates a cross-sectional line drawing of an impingement body 5″, which has a substantially constricted portion 22 in the region of its free end 7″. Only the region 23, adapted for seating on the turret 4, is cylindrical. The constriction is, looked at in vertical direction, non-symmetrical. Above the apex of the constriction, the curvature is tight, and gradually extends towards the base portion 23 of the body 5″. The radius of curvature of the contour in the zone behind the position of the articles, both in the embodiment of FIGS. 1 and 3, preferably should be less than 3 cm. This radius r is only showh in FIG. 3 for clarity. A similar radius of less than 3 cm is preferred for the region 18 of the impingement surface 14′ of the body 5′ of FIG. 2.

The constriction 22 can extend rotation-symmetrically about the longitudinal axis 6″.

Figure 4:
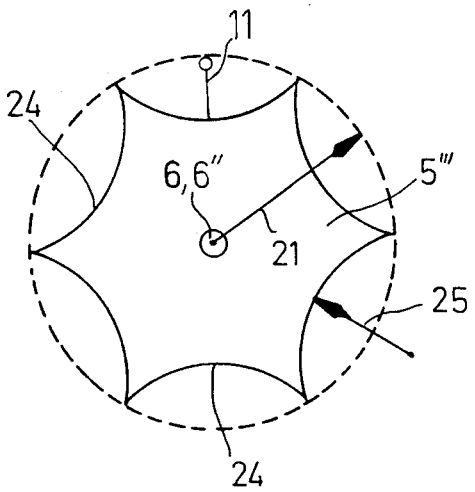
FIG. 4 is a top view of an essentially cylindrical deflection element with inwardly concave niches or depressions, extending axially, or cup-shaped depressions.

Embodiment of FIG. 4: The impingement bodies shown in FIGS. 1, 2 and 3 may, additionally, be formed with niches or depressions. In the embodiments of FIGS. 1 and 3, the depressions or niches 24 may be formed as cylindrically extending depressions, that is, depressions extending parallel to the cylinder axis 6, 6″—see FIG. 4. The number of these niches and depressions 24 will correspond to the number of the holders 11,12 for the articles to be coated. The radius of curvature 25, preferably, should be less than about 5 cm. The niches 24 additionally increase the turbulence of the tip of the flame. An essentially cylindrical impingement body 5‴ (FIG. 4) can be used, however, only for individual articles to be coated, e.g. for metallic support elements for dental crowns. Dental prosthesis parts for which more than one holder is necessary are preferably used with impingement bodies which have uniformly extending rotational surfaces, cylindrical or formed with constrictions 22, and which provide for uniform turbulence of the flame extending over the circumference of the respective impingement body 5′, 5″, 5‴.

Figure 5:
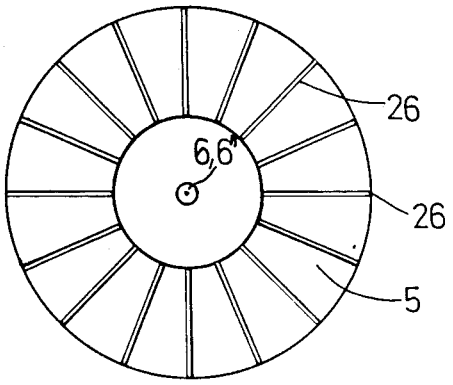
FIG. 5 is a top view of a cylindrical flame deflection surface with cooling slits.
Figure 6:
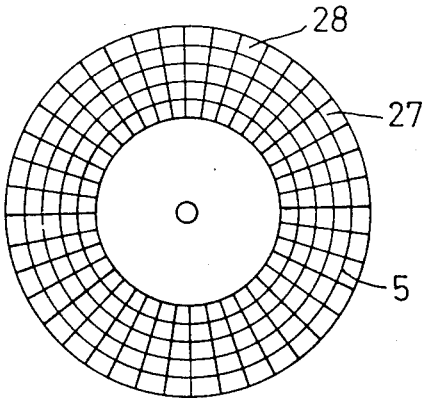
FIG. 6 is a top view of a cylindrical deflection element formed of a mesh or cellular construction, to provide enhanced cooling.

Heat may accumulate within the zone of reaction; excessive heat may interfere with appropriate reaction, and heat exchange is enhanced by providing the impingement body 5, 5′, 5″ with escape openings for heat, by heat convection, particularly at the curved upper portion thereof. Such heat exit openings may be formed by cooling slits 26, extending, for example, in the direction of the axes (6, 6″) of the cylinders. The width of the slits 26 preferably is less than 1 mm. Such slits 26 are shown at FIG. 5. FIG. 6 illustrates another embodiment in which the respective impingement body is formed as a mesh-like wire fabric 28 having exit openings 27 of comparable dimensions, that is, smaller than 1 mm. The textile mesh 27 forms, simultaneously, the impingement surface of the impingement body in the respective region. The operation of the wire mesh, then, will be similar to that of the Davy Miner's Safety Lamp. Of course, the cooling slits 26, or the equivalent, the wire mesh 28 may also be used with the impingement body 5′ of FIG. 2.

Holder arrangements, with reference to FIGS. 7–14

Various types of holders may be used in combination with the essentially cylindrical impingement body (FIGS. 1, 3, 4) or the impingement dish (FIG. 2); the respective holders each have their specific applications and advantages.

Figure 7:
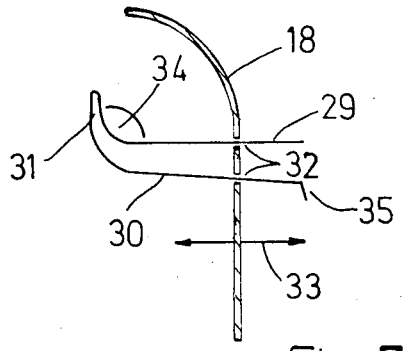
FIG. 7 is a schematic side view of a holder for sample articles to be coated.

FIG. 7 illustrates a holder passing through the impingement surface—which may be the cylindrical element of FIGS. 1, 3, 4, or the dish of FIG. 2—having two carrier arms 29, 30 made of thin wire, with angled-off ends 31 extending towards the concave impingement surface 18, and connected at the ends of the angled-off portion. The two carrier wires 29, 30 are guided through respective bores 32 in the wall of the impingement body. They are mechanically stressed with respect to each other. The can be shifted in direction of the double arrow 33, by frictional engagement in the respective holes. The holder is simple, easily adjusted, and highly reliable.

The angle of the upwardly extending portion 31, illustrated at 34, can be changed, for acceptance of various types of articles, by relatively shifting the wires 29, 30, with respect to each other, preferably, and to prevent escape of the wires, the terminal ends of the wires 29, 30 are bent, as shown with respect to wire 30 at 35. The bent portion 35 insures seating of the holder within the impingement body. Yet, it permits removal of the entire holder from the impingement body by slightly downwardly tipping the wire 30 and threading the impingement body outwardly if positive removal is desired; yet, the holder is secured with respect to undesired removal.

Figure 8:
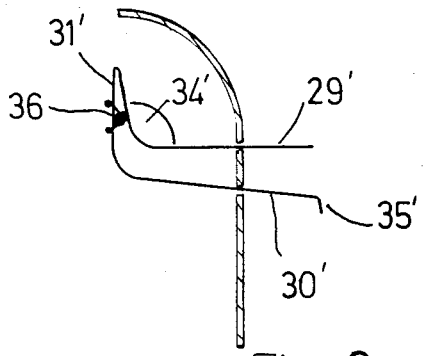
FIG. 8 is a view similar to FIG. 7 and showing another embodiment.

FIG. 8 illustrates a modification of the arrangement of FIG. 7, in which the wires 29′, 30′ are separate elements which can be connected by an additional holding spring, for example a small spiral spring, to form a clamping combination, in that the two wires 29′, 30′ can be clamped towards each other at the bent-over portion 31′. The wire 30′ is prevented from undesired removal by the bent-over portion 35′.

Figure 9:
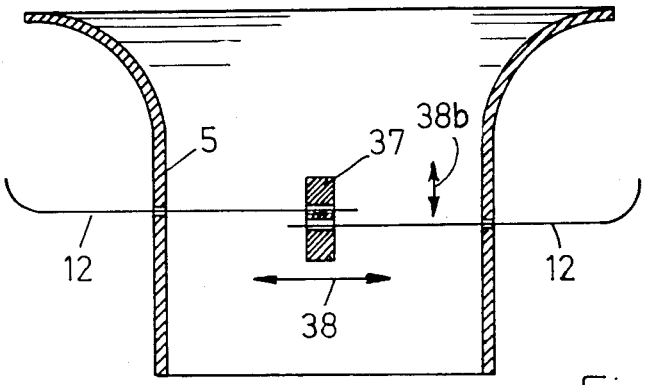
FIG. 9 is an axial view, partly schematic, illustrating connection of two holder arms located diametrically opposite a deflection element as shown in FIG. 1.
Figure 10:
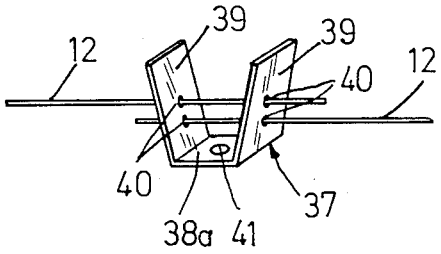
FIG. 10 is a detail perspective view of a holder arrangement.

Various other types of holders may be used, for example single-wire holders 12 illustrated in FIG. 9. The single wires are located diametrically opposite each other and retained in a common clamp 37, located within the cylindrical impingement body 5, and, preferably, at the central axis 6 thereof. The holder arms 12 may be retained in the clamp by springs or by friction and permit shifting in the direction of the double arrow 38, individually, with respect to each other. The clamp 37 may be a sheet metal spring or spring strip, bent into V or U shape, having a flat portion 38*a* (FIG. 10) and two upstanding legs 39. The legs 39 are formed with bores 40 through which the wires 12 can pass. By slight compression of the legs 39, the wires 12 can be shifted in the direction of the arrow 38 (FIG. 9) and, upon release of the legs 39, the springs will be reliably held in position. The clamp 37 can be held by attachment in an opening 41 within the cylindrical body 5, or can be secured to another base structure on the turret.

Figure 11:
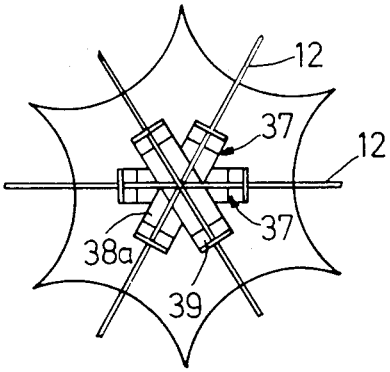
FIG. 11 is a schematic top view of a holder arrangement for a deflection element as shown in FIG. 4.

A plurality of clamps 37 can be located above each other connected, for example, to form a single holder unit, as seen in FIG. 11. Each one of the clamps can be individually adjusted for individual placement of the holder arms 12. This arrangement is particularly suitable for a body as shown in FIG. 4.

Figure 12:
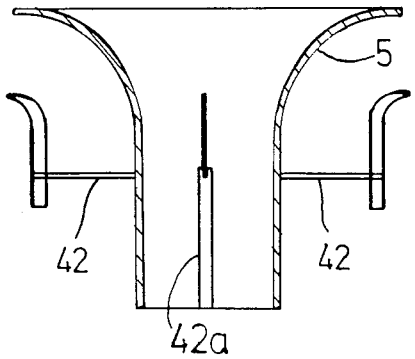
FIG. 12 illustrates a holder arrangement for articles, suitable with the deflection element of FIG. 1.

FIG. 12 illustrates another arrangement to attach holders on a separate holder support 42. The holder support 42 may be a circumferential spider, arranged with openings to receive holder wires, similar to the holder wires 29, 30 or 29′, 30′ of FIGS. 7 and 8.

Figure 13:
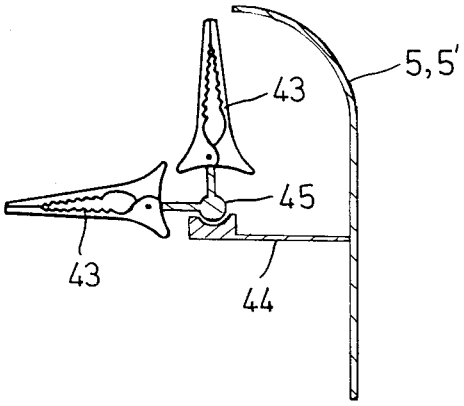
FIG. 13 is a detail view showing holders for articles using alligator clips.

For some apparatus, holders using alligator clips 43 are desirable—see FIG. 13. The alligator clips 43 are located at the end of support arms 44 secured, for example, to the respective support body 5, 5', 5''. A ball joint 45 which, preferably, can be clamped by means of a set screw, as well known (not shown in FIG. 13), permits universal placement of the alligator clips 43. Alternatively, the clips 43 can be directly attached to the wall of the impingement body 5, 5', 5'', 5''', preferably using a ball joint.

Figure 14:
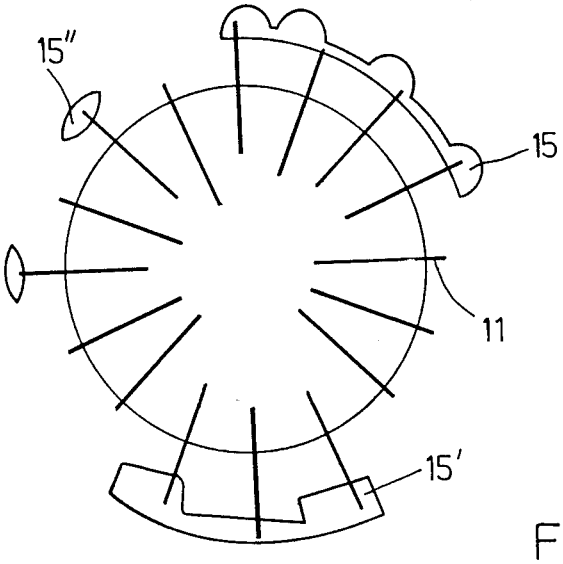
FIG. 14 is a top view of an essentially cylindrical deflection surface showing, in highly schematic form, different articles retained on the holders in the apparatus.

FIG. 14 illustrates a holder arrangement for various types of articles to be coated. Large articles 15, for example for dental bridges or the like, can be clamped in position; if not all of the holders 11 are needed, they can be pushed radially inwardly into the body 5, so that the holders are not exposed to the full force of the direct flame. In such an arrangement, the diameter of the cylindrical body 5 is, preferably, in the order of about 5 cm. This arrangement is particularly suitable for different types of articles 15, 15', 15'''.

The cooling slits 26 (FIG. 5) prevent excessive heat build-up due to the flame, particularly in the end region of the concave surface 18 of the respective bodies 5, 5', 5'' . . . A similar effect is obtained by the wire mesh structure of FIG. 6; the mesh width of the structure of FIG. 6 is preferably less than 1 mm; the cooling slits 26 (FIG. 5) should, preferably, not exceed 1 mm in width. The cooling slits should be so located that they are at the upper side of the respective impingement body when subjected to the flame.

Suitable structures for a cylindrical impingement body are hollow cylinders which are upwardly expanded, upwardly constricted with an expansion extension (FIG. 3) and the like; the zone of the constriction preferably is essentially parabolic towards the outer contour.

In accordance with a preferred feature of the invention, the turret is so arranged that various impingement surfaces can be selectively placed thereon. The attachment of the impingement surface to the turret can be in accordance with any well known and suitable construction, for example by a small upwardly extending stepped disk, concentric with the inner diameter of the body 5, 5'', for example, with snap-on attachments, a clamping ring, or the like. Alternatively, the turret can be formed with a basic attachment body on which suitably shaped sleeves are placed, which form the actual impingement surfaces. This arrangement is particularly desirable, since the impingement surface is subject to wear, that is, will require eventual replacement due to the exposure to the flame. The turret and/or the impingement body and/or the burner should, preferably, be height-adjustable with respect to each other and, further, be radially adjustable with respect to each other, so that the impingement zone of the flame and the turbulence and reflection and deflection zone of the flame for the flame hydrolysis can be adjusted for optimum results and optimum coating of the articles 15 (FIG. 14).

The depressions or recesses or niches 24 (FIG. 4) increase the turbulence of the tip portion of the flame. These niches may extend axially or may be formed to extend in the shape of radial grooves in the body 5' (FIG. 2). These niches may be formed also as cup-shaped depressions, for example of essentially part-spherical or part-rotational shape or with parabolic-shaped cross section, located in the region behind holders for individual articles. Such depressions or niches can be formed in addition to the concave outer contour of an essentially rotation-symmetrical body 5, 5', 5''. The radius of curvature of the depressions, preferably, is less than 5 cm.

The respective articles to be coated should be placed at the optimum spacing to the flame, to obtain optimum volume within the reaction zone. The shape of the holders and the holding arms for the respective articles thus should be adjustable, and holder arms which extend directly from the impingement surface and formed unitary with the impingement surface, are suitable. Such holder arms, secured to the body, can then be placed on the turret as a unit together with the articles to be coated—or which have been coated—so that the articles can be placed on the impingement bodies before being attached to the turret, and removed from the impingement surface, after coating, away from the turret; a plurality of impingement bodies, thus, with the holders thereon may be provided together with a single coating apparatus, to permit loading of the holders on an impingement body while another body is on the turret and coats articles; and unloading coating articles during operation of the coating apparatus with another impingement body. This permits associating the most suitable holder elements with the articles to be coated outside of the coating apparatus. Availability of a plurality of impingement bodies, possibly with different types of holders—see FIGS. 7–13—thus insures rapid and efficient overall coating operation. Alligator clips (FIGS. 2, 13) are particularly suitable, especially when coupled with a ball joint to the respective impingement body, so that the alignment of the articles with respect to the impingement body can be readily adjusted. Holder wires, particularly angled-off holder wires (FIGS. 7, 8, 12) are suitable, especially for smaller articles, and may be used especially for the base structure of a dental crown. Such holders, especially those using two holder arms (FIGS. 7, 8) are simple in construction, easily changed, and highly versatile in application. The two holder arms which extend towards each other with their free ends, and formed, for example, as a thin wire, can be carried through suitable openings or bores in the impingement surface, e.g. through the wire mesh, and by simple sliding of the wires against each other, the spacing from the impingement surface can be changed. The wires, preferably of spring wire, are biassed towards or away from the spacing of the openings, so that they are held by frictional engagement. The elements, converging towards each other, can clamp the articles therebetween.

In some arrangements, the cost of holders—and their replacement, since they are subjected to the flame—justifies a more complex construction. Some holders may be rigidly secured to the turret, and carried through the cylindrical impingement body which, then, is formed with suitable slits **42*a* (FIG. 12) to permit passage of the holders arms 42** therethrough. This permits replacement of the cylindrical impingement body.

Use of a clamp (FIGS. 10, 11) made of spring sheet steel is particularly simple, especially when located within a hollow cylindrical impingement body 5, 5'', 5'''. The arrangement in which two diametrically opposite holder arms are connected by a single clamp improves the stability of both the holder arms as well as of the clamp attachment. The holder arms can be easily shifted by merely compressing the V or U-shaped legs 39 towards each other, thus freeing slightly oversized holes 40 from the wires 12, permitting precise adjustment of the ends of the wires. The clamps can be secured in any suitable manner, for example by an internal spider, by screw connection or the like either to the impingement body or to the turret 4, in accordance with any well known and suitable construction. Of course, dual wires 29, 30 (FIGS. 7, 8) can likewise be attached in this manner.

Various changes and modifications may be made, and features described in connection with any one of the embodiments may be used with any of the others, within the scope of the inventive concept.

For example, the holder 37 (FIG. 9) can be height-adjustable, as schematically indicated by arrow 38*b*, the openings in the body 5 then being formed with elongated slits 42*a* (FIG. 12), rather than mere through-bores slightly larger than the holders 12 (FIG. 9), to provide for a greater latitude of adjustment.

We claim:

1. Flame hydrolysis coating apparatus, particularly for coating of articles such as dental prostheses with a silicon oxide adhesion promoting cover or coating, having a flame hydrolysis burner (10) projecting an elongated flame cone towards the articles (15);

a turret (3, 4) rotatable about a turret axis (3);

holder means (11, 12) holding and supporting the articles (15) to be coated, and secured to and rotatable with the turret, and comprising, in accordance with the invention, means for generating turbulence at the tip of the elongated flame cone (9) including a deflection surface (8, 8') located—with respect to the flame projection—behind the holder means (11, 12) for the articles and positioned to be impinged by the tip of the flame to deflect the tip of the flame thereby from conical form and introduce turbulence (16) in the flame tip in the region of the articles (15) held in the holder means and reflecting the flame from behind the articles back towards the articles.

2. Apparatus according to claim 1, wherein the deflection surface (8, 8'') is formed by a deflection body (5, 5'', 5''') of generally cylindrical shape, and having a cylinder axis (6) forming an extension of the axis of rotation (3) of the turret.

3. Apparatus according to claim 1, wherein the deflection surface (8') is formed by a deflection body (5') of generally dish-shaped form, and positioned to rotate about an axis of rotation (3') essentially parallel to the direction of flame projection.

4. Apparatus according to claim 1, wherein the deflection surface (8, 8', 8'') has a region which is concave with respect to the flame cone (9, 9').

5. Apparatus according to claim 4, wherein the concave region (14, 18) of the deflection surface (8, 8', 8'') extends in overlapping direction above the region of turbulence (16) of the elongated flame cone.

6. Apparatus according to claim 4, wherein the radius of curvature of the concave region (14, 18) of the deflection surface (8, 8', 8'') is up to about 3 cm.

7. Apparatus according to claim 1, including a deflection body (5, 5', 5'', 5''') having the deflection surface formed as the outer surface thereof;

and wherein cooling slits (26) having a width less than about 1 mm are formed in the deflection body at least in the region above the impingement of the flame cone, and said flame turbulence thereagainst.

8. Apparatus according to claim 1, including a deflection body (5, 5', 5'', 5''') having the deflection surface formed as the outer surface thereof;

and wherein the deflection body is formed as a wire mesh at least in the region above the impingement of the flame cone, and said flame turbulence thereagainst, the wire mesh having a mesh width of less than about 1 mm.

9. Apparatus according to claim 1, including a deflection body (5, 5'', 5''') formed as a hollow cylinder secured to the turret, in which the cylinder axis (6) is congruent with said axis of rotation (3), the hollow cylinder having an expanded outwardly flaring region (7) extending over about one-third of the axial length thereof, and flaring above the tip of the elongated flame cone (9) and the region of turbulence thereof.

10. Apparatus according to claim 1, including a deflection body (5'') formed as a hollow, generally cylindrical structure secured to the turret, in which the cylinder axis is congruent with the axis of rotation, said structure being formed with a radial constriction (22) in the region opposite the elongated flame cone, and the region of turbulence thereof, the zone of the generally cylindrical structure above said flame cone flaring outwardly to overlap the tip of the flame cone and the region turbulence.

11. Apparatus according to claim 10, wherein the outer contour of said generally cylindrical structure, in the region of the constriction, is generally parabolical.

12. Apparatus according to claim 1, including a deflection body having the deflection surface formed as the outer surface thereof;

and wherein said deflection body is releasably, replaceably secured to the turret (4).

13. Apparatus according to claim 1, including a deflection body having the deflection surface formed as the outer surface thereof, the deflection body being secured to the turret (4);

means (1, 2) rotating the turret about the turret axis;

and wherein the turret is height-adjustable (4*a*) with respect to the tip of the elongated flame cone (9).

14. Apparatus according to claim 1, wherein the deflection surface is formed by a deflection body of general dish shape, having an axis of rotation extending parallel to the direction of the flame (9') projection;

and wherein the relative position of the dish-shaped deflection body (4') with respect to the flame tip, and the region of turbulence (16') thereof is selectively adjustable.

15. Apparatus according to claim 1, including (FIG. 4) a deflection body (5''') having the deflection surface formed as the outer surface thereof;

and wherein said deflection surface includes a plurality of niches or depressions (24) formed therein and laterally generating turbulence of the tip of the elongated flame cone, the holder means (11) being locasted in said niches or depressions and within the zone of impingement and turbulence of the flame tip extending into said niches or depressions.

16. Apparatus according to claim 15, wherein the niches or depressions are formed with a radius of curvature of up to about 5 cm.

17. Apparatus according to claim 1, including a deflection body having the deflection surface formed as the outer surface thereof, said deflection body being formed as a body of rotation;

and wherein said holder means extend, at least in part, radially from the deflection surface.

18. Apparatus according to claim 17, wherein the holder means includes a ball joint (45) and alligator clips (43) secured to the ball joint.

BEST AVAILABLE COPY

19. Apparatus according to claim 17, wherein the holder means comprises support arms (34, 34') having end portions which are bent over at angles in the order of about 90°.

20. Apparatus according to claim 19, wherein the holder means comprises a pair of support arms (29, 30, 29',30').

21. Apparatus according to claim 20, wherein the pairs of support arms are connected together at the bent-over end portions (31).

22. Apparatus according to claim 1, including a deflection body (5) formed as a generally cylindrical hollow structure, secured to the turret (4);

said deflection body being formed with axial slits (42*a*);

and wherein the holder means (11) are secured to the turret and extend radially outwardly from the essentially cylindrical body through said axial slits (42*a*).

23. Apparatus according to claim 1, wherein the holder means (11) are axially movable with respect to at least one of: the turret; the deflection surface.

24. Apparatus according to claim 1, wherein the holder means (11) are movable radially with respect to the axis of rotation (3) of the turret.

25. Apparatus according to claim 1, including a deflection body formed as a hollow, generally cylindrical structure secured to the turret;

and the holder means (11, 12) comprise diametrically oppositely located support arms (12), and a common clamp (37) adjustably retaining the support arms in position.

26. Apparatus according to claim 25, wherein the clamp comprises a sheet spring element of essentially U-shaped form, having two upstanding legs (39) and a bottom portion (38*a*), and openings (40) formed in the upstanding legs (39) for receiving the support arms and clamping the support arms under spring loading in position.

27. Apparatus according to claim 27, wherein the bottom portion (38*a*) of the clamp is secured to the turret.

28. Apparatus according to claim 1, including a deflection body (5, 5', 5'', 5''') having the deflection surface formed as the outer surface thereof;

and including cooling slits (26) formed in an end region of the deflection surface at least upwardly of the turbulent or swirling tip zone of the flame.

29. Method of coating articles by flame hydrolysis including the steps of:

projecting an elongated flame cone towards the articles;

and creating flame turbulence or swirling in the region of impingement of the flame cone on the articles by redirecting the tip portion of the flame cone at a region located—with respect to flame projection—behind the articles to thereby cause turbulence at the tip portion of the flame, and to reflect a portion of the flame back towards the articles from the rear surface—with respect to flame projection—thereof.

30. Method according to claim 29, including the step of reflecting and deflecting the flame in the region of turbulence surrounding the articles by redirecting the flame in a region above the articles to thereby confine the zone of swirling or turbulence to the region surrounding said articles.

31. Method according to claim 29, including the step of cyclically moving the articles through said zone of turbulence.

• • • • •